United States Patent [19]

Federighi et al.

[11] 4,235,642

[45] Nov. 25, 1980

[54] DISHWASHER USING STEAM TO HEAT COLD WASH AND RINSE WATERS AND SPRAY THEM AGAINST DISHES DURING THE WASH AND RINSE CYCLES

[76] Inventors: George J. Federighi; George B. Federighi, both of 70 Thirteenth St., San Francisco, Calif. 94105

[21] Appl. No.: 973,898

[22] Filed: Dec. 28, 1978

[51] Int. Cl.[3] ..... B08B 3/02

[52] U.S. Cl. ..... 134/58 D; 134/102; 134/106

[58] Field of Search ..... 134/58 D, 95, 100–102, 134/106

[56] References Cited

U.S. PATENT DOCUMENTS

| | | | |
|---|---|---|---|
| 3,021,863 | 2/1962 | Low | 134/100 X |
| 3,484,811 | 12/1969 | Weihe, Jr. | 134/100 X |
| 3,589,378 | 6/1971 | Swanson et al. | 134/100 X |
| 4,134,413 | 1/1979 | Noren | 134/58 D X |
| 4,135,531 | 1/1979 | Federighi et al. | 134/95 |

*Primary Examiner*—Robert L. Bleutge

*Attorney, Agent, or Firm*—Alvin E. Hendricson; William R. Piper

[57] ABSTRACT

A dishwasher using steam to heat cold wash water and to propel the heated wash water through a spray arm mounted in a dish containing compartment for washing dishes for a predetermined time period. A detergent liquid is added to the wash water and the entraining action of the steam in withdrawing wash water from a tank underlying the compartment is also used in withdrawing a volume of detergent from a source of supply and delivering it into the wash water. The steam from a boiler is also used to heat cold rinse water delivered to the tank after the wash water has been drained therefrom and to propel this heated rinse water through the spray arm for rinsing the dishes after a predetermined time period. A sterilizing liquid and a rinse aid are added to the rinse water at the start of the rinsing cycle.

2 Claims, 7 Drawing Figures

DISHWASHER USING STEAM TO HEAT COLD WASH AND RINSE WATERS AND SPRAY THEM AGAINST DISHES DURING THE WASH AND RINSE CYCLES

CROSS REFERENCE TO RELATED APPLICATION

In our copending patent application on a dishwasher operated solely by steam and hot water, Ser. No. 830,920, filed Sept. 6, 1977, now U.S. Pat. No. 4,135,531, we disclosed a dishwasher in which a steam boiler is used and hot wash water in the tank underlying the wash/rinse compartment is entrained by the steam from the boiler and is directed through wash spray arms against the dishes during the washing cycle. No motor or pump is needed for this purpose. Then during the rinse cycle, hot rinse water from the boiler is fed directly to rinse spray arms in the compartment for rinsing the dishes and the pressure within the boiler is sufficient to accomplish this without the need for a motor driven pump.

SUMMARY OF THE INVENTION

An object of our present invention is to deliver cold wash water into the tank underlying the wash/rinse compartment and use steam to entrain and heat the cold water for delivering the heated water at about 130° F., mixed with steam and forcing it against the dishes for washing them. This hot water is returned to the tank by gravity and is reused during the washing cycle. We have found that when the cold wash water is heated and propelled by the steam it will have a tendency to cling and flow over the dishes producing a more effective washing operation than is possible in the standard dishwasher where the pump propelled wash water has a tendency to strike the dishes with a force sufficient to cause the water to bounce off from the dishes. A detergent is fed into the wash water.

A further object of our present invention is to deliver cold rinse water into the tank after draining the wash water therefrom and to steam heat and propel this heated rinse water through the wash/rinse spray arm in the compartment for rinsing the dishes during the rinse cycle. A sanitizing agent and a rinse aid are fed into the rinse water and this permits the rinse water to sterilize the dishes at a lower temperature of 120° F., rather than the usual higher temperature of 180° F., that would be required if the sanitizing agent were not used. Also, the use of the rinse aid in the rinse water will cause a complete draining of the rinse water from the dishes without leaving any water stains on the dishes, glasses or silverware.

DESCRIPTION OF THE PREFERRED EMBODIMENT

Figure 3:
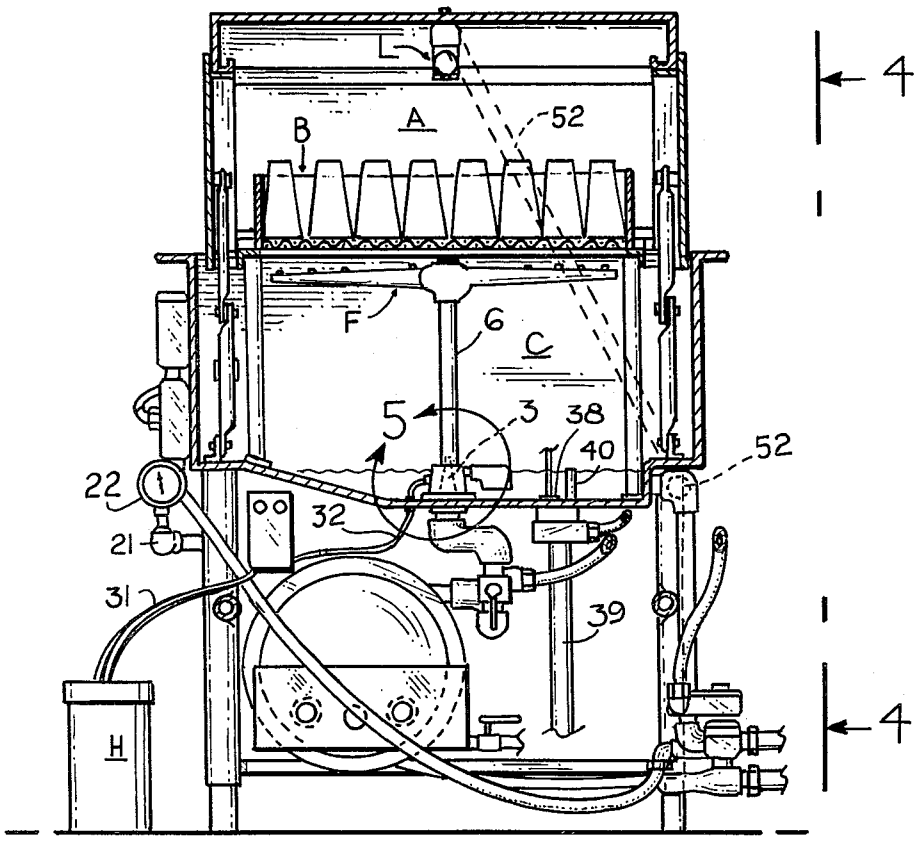
FIG. 3 is a transverse vertical section taken along the line 3—3 of FIG. 2.

In carrying out our invention we show a dishwasher in FIG. 3 that has a wash/rinse compartment A for receiving a rack B of dishes to be washed, rinsed and sterilized. The compartment overlies a tank C that is designed to receive cold wash water for the wash cycle and to receive cold rinse water for the rinse cycle after the wash water has been drained from the tank, A vertically movable door D, see FIG. 1, has a handle 1 by means of which the operator can move the door downwardly into the tank C, for opening the compartment A so that dish carrying racks may be placed in the compartment and removed therefrom.

Figure 5:
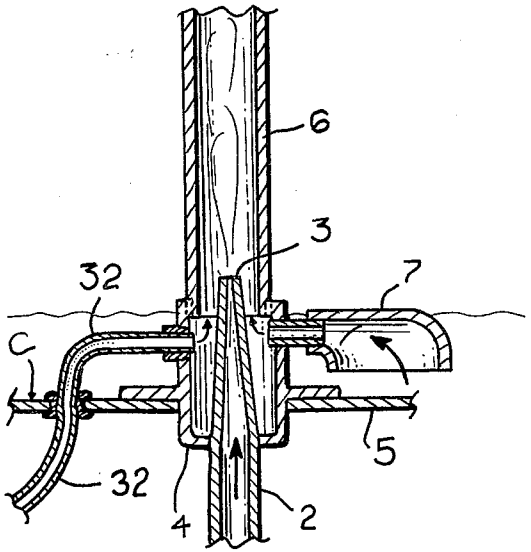
FIG. 5 is an enlarged sectional view of the circled portion 5 in FIG. 3, and illustrates the entraining action of the steam in withdrawing cold wash or rinse from the dishwasher tank and delivering it to the wash/rinse spray arm, this depending upon whether the dishwasher is in its washing or rinsing cycle. Also, the entraining action created by the steam is sufficient to draw a liquid detergent from its container during the wash cycle and to simultaneously draw a sterilizing agent and rinse aid from their respective containers during the rinsing cycle.
Figure 6:
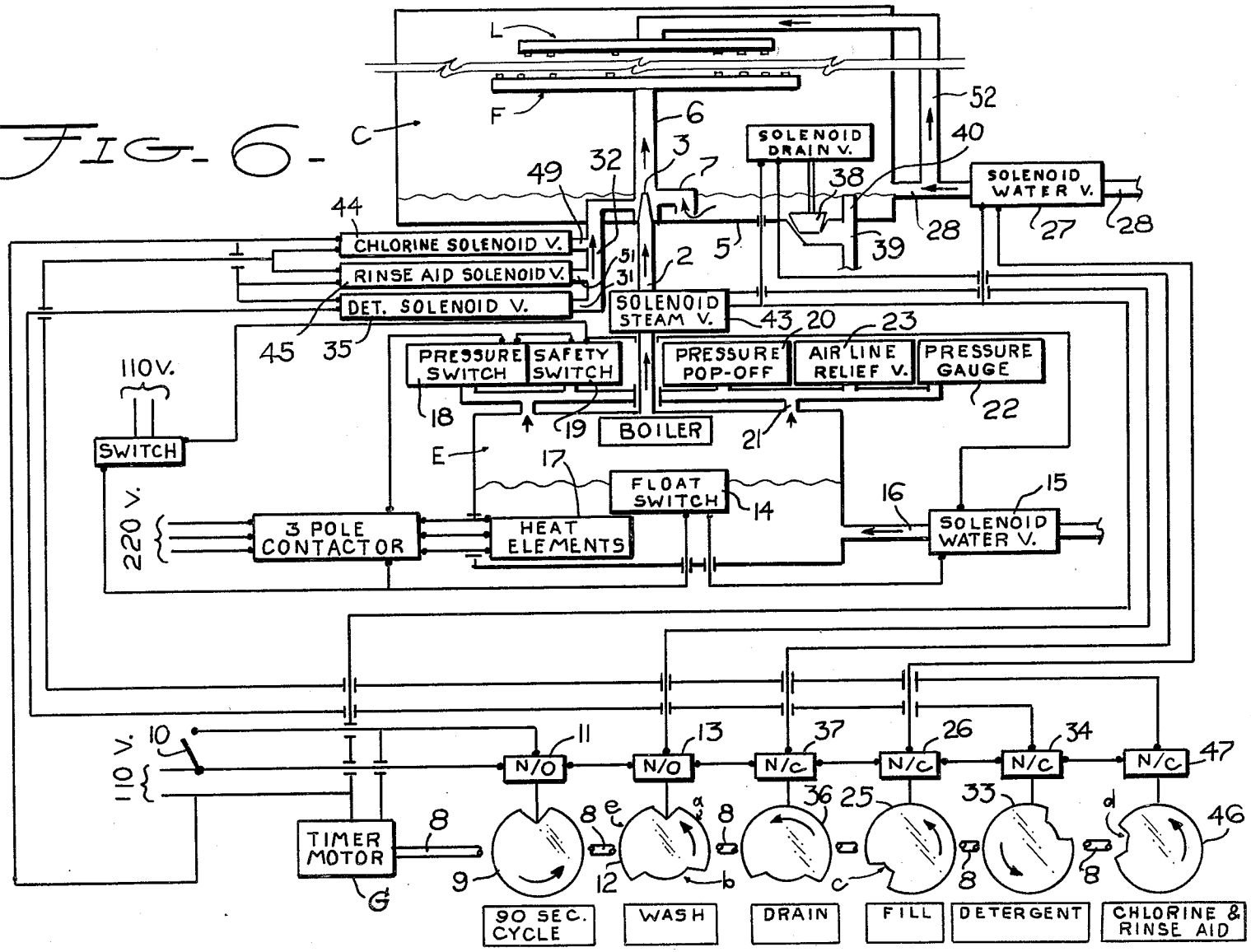
FIG. 6 is a schematic showing of the entire dishwasher and includes the timing cams that control the various functions of the dishwasher during the washing and rinsing cycles as well as the wiring diagram.

A steam boiler is shown schematically at E, in FIG. 6, and a steam conveying pipe 2 leads from the boiler to a steam jet nozzle 3. In FIG. 5, we show a vertical enlarged sectional view of the steam pipe and nozzle. A cylindrical hollow body 4 is carried by the bottom wall 5 of the tank C, and the hollow body has a pipe 6 connected thereto that communicates with a wash/rinse spray arm F, see FIG. 3. A water inlet 7 communicates with the hollow body 4, as shown in FIG. 5 and this water inlet is positioned just above the bottom wall of the tank C. We will describe hereinafter how the flow of steam from the boiler E and moving through the steam pipe 2 and steam jet 3 will create an entraining action in the hollow body 4 and pipe 6 to entrain fluid from the tank C and cause it to flow through the water inlet and enter the hollow body 4 and pipe 6 to mix with the steam and be conveyed to and ejected from the wash/rinse arm F to wash or rinse the dishes at the proper temperature during the wash and rinse cycles. We have shown only a lower wash/rinse arm F, although there could also be an upper wash/rinse arm, not shown, with a pipe, not shown, connecting it to the pipe 6 so that both arms would function at the same time.

Figure 1:
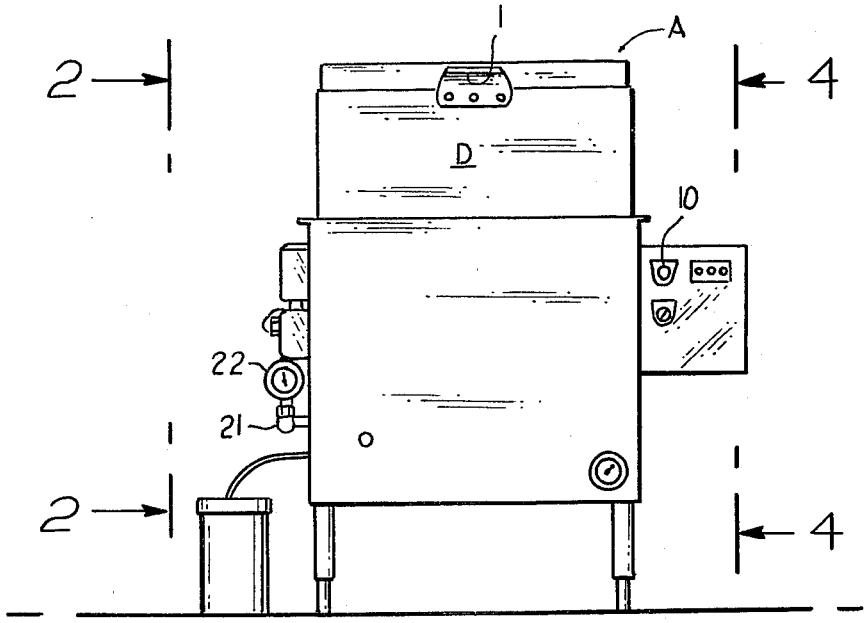
FIG. 1 is a front elevation of the dishwasher.

Referring now to the schematic showing and wiring diagram in FIG. 6, it will be seen that a timer motor is indicated at G, and this motor rotates a shaft 8. A cam 9 is mounted on the shaft. The timer motor is geared to rotate the shaft 8 and cam 9 through one complete revolution in a 90 second time period when the starting switch 10 in FIG. 1 is depressed. We do not wish to be confined to any precise time interval but we have found that the dishwasher will effectively wash, rinse and sterilize the dishes in a time interval of 90 seconds. The temporary closing of the timer switch will start the motor G, and rotate the 90 second cam 9 to close a micro switch 11 and the motor shaft 8 will also start rotating a wash/rinse cycle cam 12 to close a second micro switch 13.

When the timer motor circuit is closed, a circuit will also be closed to a float switch 14 positioned in the boiler E and if the water level in the boiler is below a predetermined height, the float switch will close a circuit to a solenoid water valve 15, see FIG. 6, that will permit fresh water to enter the boiler E through the pipe 16 until the proper water level is reached at which point the float valve will open and permit the solenoid valve 15 to close and stop the flow of water into the boiler. Water heating elements 17 will heat the water in the boiler to provide steam that is used during the washing and rinsing cycles. A pressure switch 18 is in communication with the steam boiler and when the proper pressure is reached, the pressure switch will open and cut off the current to the heating elements 18. In addition to the pressure switch 18, we make use of a safety switch 19 that will open the circuit to the heat elements 17 when a predetermined pressure within the boiler E is reached and the pressure switch 18 fails to function. As a final precaution against the steam boiler accidentally blowing up, we provide a pressure pop-off valve 20 that is in direct communication with the boiler through the pipe 21 in FIG. 6. A pressure gage 22 is in communication with the boiler E as well as an air line relief valve 23.

Figure 7:
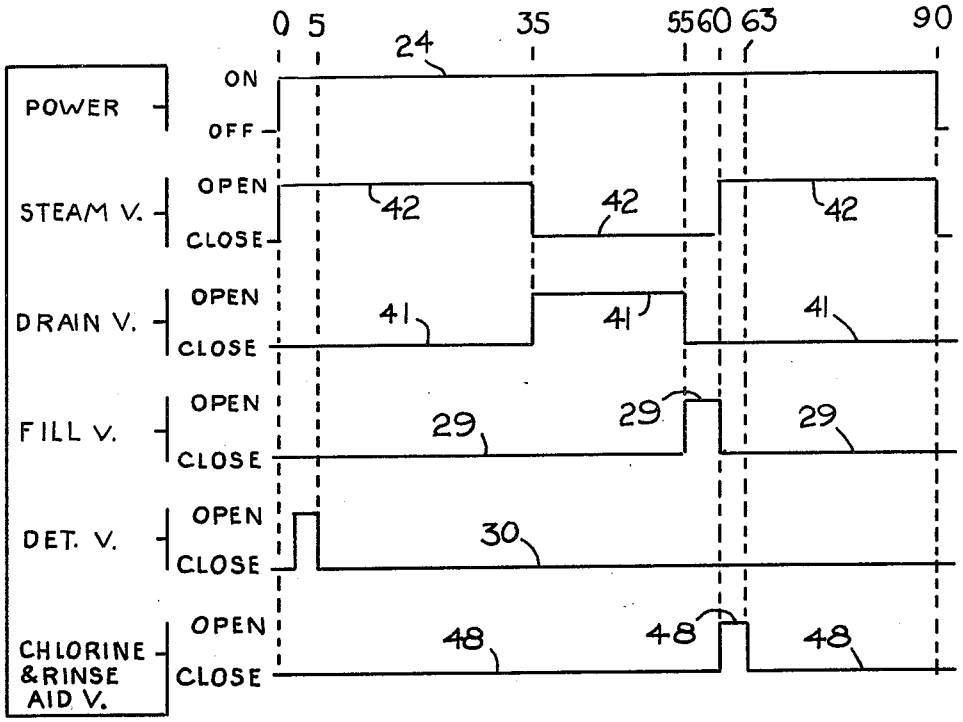
FIG. 7 is a graph of the various timing cycles.

The 90 second cam 9 will keep the micro switch closed for that period of time and the wash cam 12 will close the micro switch 13 for a time period of 35 seconds, see FIG. 6. Referring to the timing cycles in FIG. 7, the power graph line 24 is shown to be "ON" for the full 90 seconds when the starting switch 10 is closed. The water fill cam 25 on the motor shaft 8 is in a position to keep the micro switch 26 closed and this will close an electric circuit to a solenoid controlled water valve 27 to open the valve and permit fresh cold water to flow from a water supply pipe 28 into the tank C, as shown in FIG. 6. The graph line 29 in FIG. 7 shows that the fill valve cam 25 will keep the micro switch 26 closed for the first 55 seconds during the 90 seconds the dishwasher is operating. Fresh cold water enters the tank C during this 55 second period and then the solenoid valve 27 will open for 5 seconds. A predetermined volume of cold rinse water is delivered into the tank C for rinsing the dishes in the compartment A.

Figure 2:
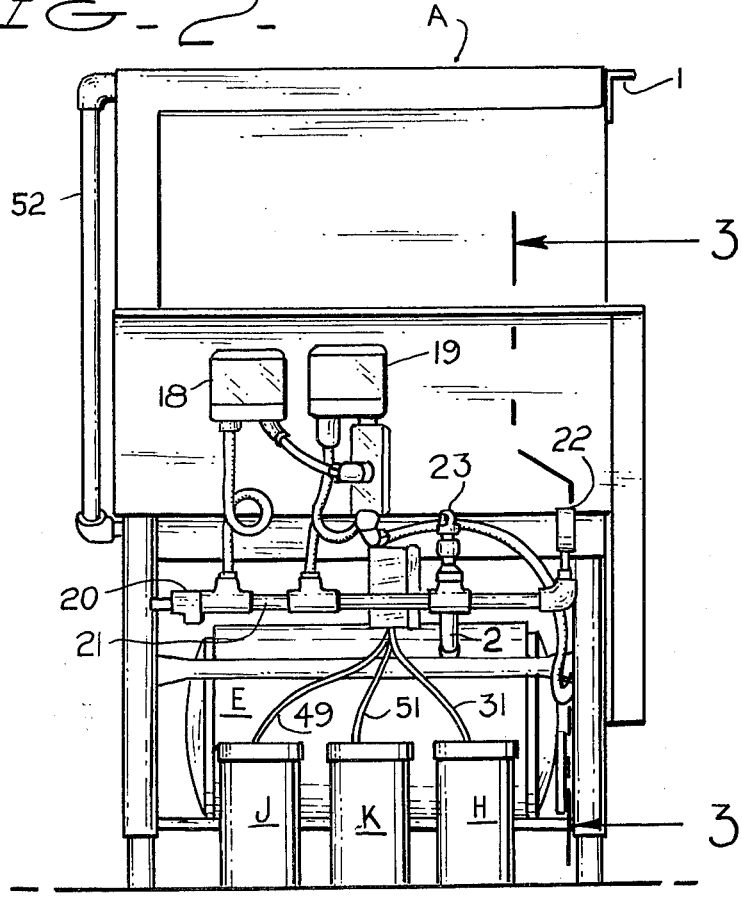
FIG. 2 is an enlarged side elevation of the dishwasher when looking in the direction of the arrows 2—2 of FIG. 1.
Figure 4:
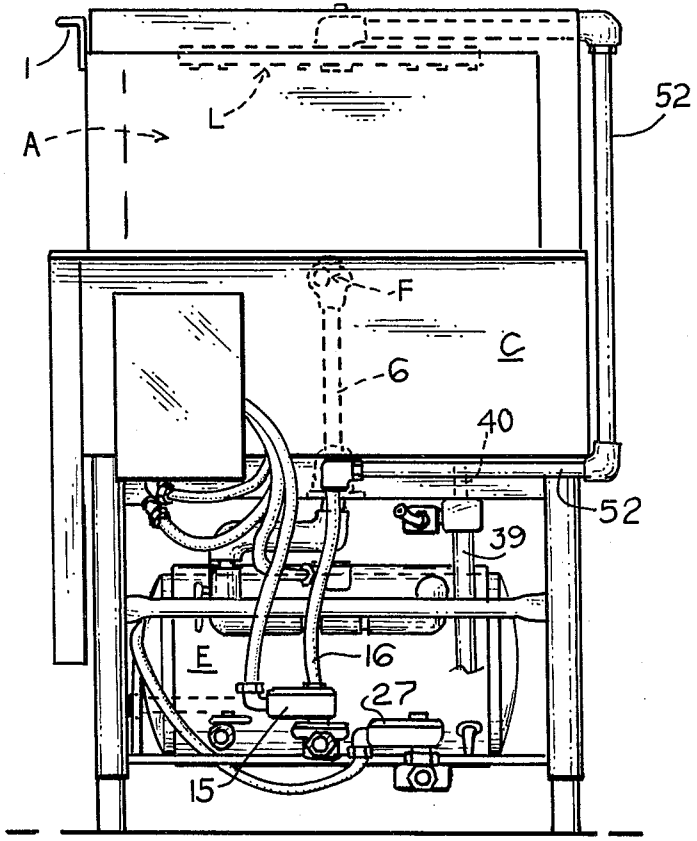
FIG. 4 is a side elevation of the dishwasher from the opposite side to that of FIG. 2 as indicated by the arrows 4—4 of FIG. 1.

It will be seen from the detergent graph line 30 that a liquid detergent is fed into the wash water in the tank C, starting at the two second interval when the power cycle is first turned "ON" and closing at the 5 second interval on the graph, see FIG. 7. In FIG. 2, we show a container H for holding a liquid detergent and a tube 31 extends from the container, see also FIG. 6, to a common tube 32 which communicates with the interior of the hollow body 4, as shown in FIG. 5. A detergent control cam 33 is mounted on the motor shaft 8 and controls a micro switch 34 that is normally closed in order to keep a detergent solenoid valve 35 closed except for the 3 second period shown by the graph line 30 in FIG. 7. During the 3 second period when the solenoid valve is open, the steam flowing through the jet 3 in FIG. 5 will create a sufficient entraining action in the hollow body 4 to draw the detergent fluid from the container H, through the detergent line 31 controlled by the valve 35 and this detergent will mix with the steam and wash water delivered to the wash/rinse arm F by the pipe 6. The wash water with the detergent will strike the dishes for washing them and then will flow by gravity back into the tank where the wash water will again be entrained through the water inlet 7 to the hollow body 4 and again forced by the steam up through the pipe 6 and out from the wash/rinse arm F, onto the dishes. This washing detergent operation will continue for the first 35 seconds of the 90 second wash-rinse allotted wash cycle.

At the end of the wash cycle a drain valve control cam 36, on the motor shaft 8, see FIG. 6, will operate a micro switch 37 to open it and permit a solenoid controlled drain valve 38 to open and allow the wash water to drain from the tank C, through a drain pipe 39 leading to a sewer. The pipe 39 also has an overflow pipe 40 in the tank C to maintain the wash water at a predetermined level. A drain valve graph line 41 in FIG. 7 shows that the drain valve will remain closed for the first 35 seconds during the wash cycle and then will open for the next 25 seconds permitting the wash water to drain into the sewer. Then the drain valve will close for the remainder of the 90 second operating time. The drain valve cam 36 has a 25 second low spot to cause the drain valve to operate in the manner just described.

While the wash cycle of the dishwasher is on the wash/rinse cam 12 high portion a for the first 35 seconds of the wash/rinse cycles, the steam line 2 will be open. The graph line 42 in FIG. 7 shows the steam line to be open during this period of time. The wash/rinse cam 12 not only controls the wash cycle for 35 seconds, but at the same time the micro switch 13 in FIG. 6 will close a circuit to the solenoid controlled steam valve 43 to open it and permit steam to flow through the pipe 2 and nozzle 3 to entrain wash water from the tank C and heat this water to about 130° F., and force it out through the wash/rinse spray arm F to effectively wash the dishes because this wash water has the liquid detergent mixed with it.

At the end of the wash cycle the wash/rinse cam 12 has a low portion b which will open the micro switch 13 and close the steam controlled solenoid valve 43. The steam valve will remain closed for 25 seconds while the drain valve 38 will be opened during this same period of time, see the steam valve graph line 42 and the drain valve graph line 41 in FIG. 7. Just before the drain valve closes, the fill valve 27, see also FIG. 6, will be opened for 5 seconds from the 55 second position to the 60 second position on the timing cycle graphs. Fresh cold rinse water will flow through the pipe 28 and into the tank C to flush the tank of its remaining wash water and to deliver a required volume of fresh rinse water into the tank at which time the drain valve 38 will close. The water fill cam 25 through the micro switch 26 controls the opening of the solenoid controlled water valve 27, when the low portion c of the cam is reached and the valve 27 will remain open for 5 seconds as also indicated by the graph line 29 in FIG. 7.

At the start of the rinse cycle (at the 60 second position on the graph line 42, in FIG. 7) the steam valve 43 will again be opened and steam will flow through the pipe 2 from the boiler E and out through the nozzle to entrain the cold rinse water from the tank C through the inlet 7 and heat this rinse water to about 120° F., and force it through the wash/rinse spray arm F to rinse the dishes. At the same time a sanitizing liquid agent valve 44, see FIG. 6, and a rinse aid valve 45 will both open since they are both controlled by a cam 46 in FIG. 6, and the cam has a low portion d which will open a micro switch 47 for only about three seconds, see the graph line 48 in the timing cycles chart in FIG. 7. The wash/rinse cam 12 not only controls the wash cycle but also the rinse cycle and the high portion e on the cam will close the micro switch 13 for 30 seconds, see the graph line 42. During this 30 second rinse cycle the steam controlled solenoid valve 43 will be opened and steam will flow through the pipe 2 and steam nozzle 3 to entrain the rinse water from the tank C, into the water inlet 7 and hollow body 4 and pipe 6 to heat the rinse water to about 120° F., which is sufficient to rinse and sterilize the dishes because the liquid sanitizing agent has been fed into the rinse water from the container J, see FIG. 6, and into the common tube 32 on its way into the hollow body 4 to mix with the rinse water. The graph line 48 shows that the chlorine controlled solenoid valve 44 will be opened only for 3 seconds at the start of the rinse cycle. A sufficient volume of chlorine is fed into the rinse water to effectively sterilize the dishes even though the water temperature is about 120° F., rather than the 180° F., required if no chlorine were used.

At the same time the chlorine solenoid valve 44 is opened for 3 seconds at the start of the rinse cycle a rinse aid solenoid valve 50 will also be opened, see FIGS. 2 and 6. The entraining action of the steam flowing from the steam nozzle 3 will create a suction in the hollow body 4 and common pipe 32, see FIG. 5, to draw liquid rinse aid from a tube 51 that is controlled by the solenoid valve 45 and extends to a container K, in FIG. 2, that holds the rinse aid. The graph line 48 in FIG. 7 shows that the rinse aid line 51 will be open for 3 seconds at the start of the rinse cycle. The cam 46 on the motor shaft 8 will close the micro switch 47, see FIG. 6, and the rinse aid solenoid valve 45 will close.

When the rinsing, sterilizing and rinse aid operation is completed the cam 9 will have completed its 90 second single revolution and the cam will open the micro switch 11 and shut off the power circuit. The rinse water can remain in the tank C, and be used as the wash cycle for the next washing and rinsing cycles when all of the various cycles will be repeated.

The pressure gage 22 will indicate the steam pressure in the boiler E, and will inform the operator when he can start the dishwasher when the desired steam pressure is reached. It is best to operate the dishwasher for the complete 90 second period because the heated rinse water remaining after the first operation of the machine now becomes the wash water for the second 90 second operation of the dishwasher.

When glasses are washed, they are placed in an inverted position in the dish rack B, as shown in FIG. 3. It is wise to flow rinse water over these inverted glasses to remove any wash water that has detergent mixed with it. We have shown in the schematic view of FIG. 6, a branch pipe 52 leading from the pipe 28 and communicating with an upper spray arm L, mounted in the wash/rinse compartment A. The opening of the solenoid water valve 27 for the 5 second period at the end of the wash cycle, see the graph line 29 in FIG. 7, will permit rinse water to enter the tank C. At the same time part of this water will flow through the branch pipe 52 and be sprayed from the upper spray arm L onto the glasses and/or dishes for removing any detergent wash water from them.

We claim:

1. In a dishwashing machine having a wash/rinse compartment for receiving a dish-carrying basket;

a tank disposed beneath said compartment;

a water containing boiler positioned beneath said tank with heating means in said boiler for generating steam;

a source of unheated water connected to said tank;

an aspirating nozzle connected to said boiler for receiving steam therefrom and extending into said tank with a water inlet communicating with said tank, a wash/rinse arm mounted on said nozzle;

time controlled means for actuating said boiler heating means for generating steam and delivering same through said aspirating nozzle for withdrawing water from said tank and entraining same with said steam and propelling said steam and water through said spray arm over the dish-carrying basket for a predetermined period of time during a washing cycle;

a detergent supply positioned beneath said tank; and a conduit having time controlled valving means therein connecting said detergent supply with said aspirating nozzle for withdrawing a supply of detergent and entraining same with said steam and water for delivery to said wash/rinse arm.

2. In a dishwashing machine as set forth in claim 1 wherein said tank is provided with a supply of unheated water subsequent to the washing operation, container means for a sanitizing liquid and a rinsing aid positioned beneath said tank, a conduit having time controlled valving means therein connecting the container means for each of said sanitizing liquid and rinsing aid with said aspirating nozzle for withdrawing a supply therefrom and entraining same with said steam and water for delivery to said arm for rinsing said dish carrying basket.

* * * * *